US006983506B1

(12) United States Patent
Brown

(10) Patent No.: US 6,983,506 B1
(45) Date of Patent: Jan. 10, 2006

(54) UNIVERSAL, INTERCHANGEABLE TOOL ATTACHMENT SYSTEM

(76) Inventor: Coffee Brown, 700 Solano Dr. SE., Albuquerque, NM (US) 87108

( * ) Notice: Subject to any disclaimer, the term of this patent is extended or adjusted under 35 U.S.C. 154(b) by 0 days.

(21) Appl. No.: 10/301,280

(22) Filed: Nov. 20, 2002

Related U.S. Application Data

(60) Provisional application No. 60/332,259, filed on Nov. 20, 2001.

(51) Int. Cl.
*B25B 7/22* (2006.01)

(52) U.S. Cl. ..... 7/168; 7/118; 7/128; 81/427.5; 81/177.4

(58) Field of Classification Search ..... 7/127–129, 7/158, 168, 167, 118; 81/177.2, 490, 423, 81/427.5, 463, 465, 466, 477, 186, 467
See application file for complete search history.

(56) References Cited

U.S. PATENT DOCUMENTS

| | | | | | |
|---|---|---|---|---|---|
| 753,456 | A | * | 3/1904 | Weidinger | 81/423 |
| 810,148 | A | | 1/1906 | Hornby | |
| 1,561,993 | A | | 11/1925 | Nielsen | |
| 1,620,574 | A | | 3/1927 | Savage | |
| 2,168,405 | A | | 8/1939 | Haas | |
| 3,370,307 | A | | 2/1968 | Beeks | |
| 3,798,687 | A | | 3/1974 | Stevens | |
| 3,858,258 | A | | 1/1975 | Stevens | |
| 4,122,569 | A | | 10/1978 | Hitchcock | |
| 4,238,862 | A | | 12/1980 | Leatherman | |
| 4,744,272 | A | * | 5/1988 | Leatherman | 81/427.5 |
| 4,888,869 | A | | 12/1989 | Leatherman | |
| 4,908,947 | A | * | 3/1990 | Schaub | 30/155 |
| 4,942,637 | A | | 7/1990 | Yeang-Yai | |
| 5,029,355 | A | | 7/1991 | Thai | |
| 5,142,721 | A | | 9/1992 | Sessions et al. | |
| 5,212,844 | A | | 5/1993 | Sessions et al. | |
| 5,267,366 | A | | 12/1993 | Frazer | |
| 5,361,655 | A | * | 11/1994 | Fowlkes | 81/177.2 |
| 5,432,968 | A | | 7/1995 | Beck | |
| 5,450,774 | A | * | 9/1995 | Chang | 81/440 |
| 5,581,834 | A | * | 12/1996 | Collins | 7/118 |
| 5,697,114 | A | | 12/1997 | McIntosh et al. | |
| 5,735,005 | A | | 4/1998 | Wang | |
| 5,826,338 | A | | 10/1998 | Chilton et al. | |
| 5,916,277 | A | | 6/1999 | Dallas | |
| 5,920,935 | A | | 7/1999 | Beck | |
| 5,960,498 | A | * | 10/1999 | Nabors et al. | 7/128 |
| 6,006,385 | A | | 12/1999 | Kershaw et al. | |
| 6,023,805 | A | | 2/2000 | Lin | |
| 6,047,426 | A | | 4/2000 | McIntosh et al. | |
| 6,101,654 | A | | 8/2000 | Cachot | |
| 6,250,184 | B1 | * | 6/2001 | Chang | 81/415 |
| 6,282,995 | B1 | * | 9/2001 | Lin | 81/423 |
| 6,386,076 | B1 | * | 5/2002 | Swanstrom, Jr. | 81/423 |
| 6,612,147 | B2 | * | 9/2003 | Beetz et al. | 72/409.16 |

FOREIGN PATENT DOCUMENTS

| | | |
|---|---|---|
| DE | 100 56 900 | * 11/2000 |

* cited by examiner

*Primary Examiner*—Hadi Shakeri
(74) *Attorney, Agent, or Firm*—Deborah A. Peacock; Jeffrey D. Myers; Vidal A. Oaxaca

(57) ABSTRACT

A universal, interchangeable attachment system, comprising various tool operator heads, removable/interchangeable handles, removable/replaceable tools and tool bits, hex drive, and clamp for securing tools. An electronic subsystem provides an alternating current detector, an indicator, such as an LED or light bulb, and continuity circuit indicator. A reversible double helical drive enables a user to drive a screw or bolt.

19 Claims, 18 Drawing Sheets

FIG. 13a
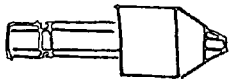
(Illustration of Prior Art)
FIG. 13b
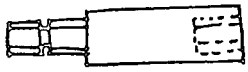
(Illustration of Prior Art)
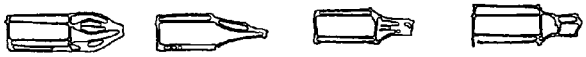
FIG. 13c (Illustration of Prior Art)
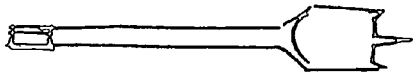
FIG. 13d (Illustration of Prior Art)
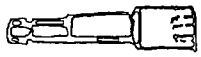
FIG. 13e (Illustration of Prior Art)
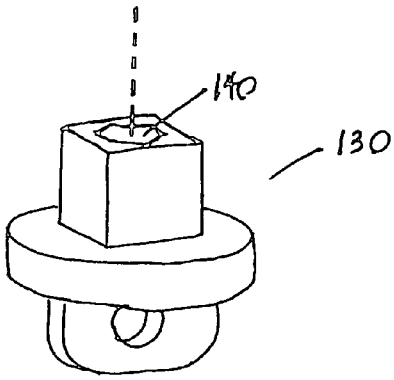
FIG. 13f
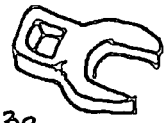
FIG. 13g (Illustration of Prior Art)
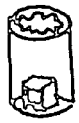
FIG. 13h (Illustration of Prior Art)
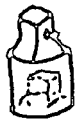
FIG. 13i
(Illustration of Prior Art)
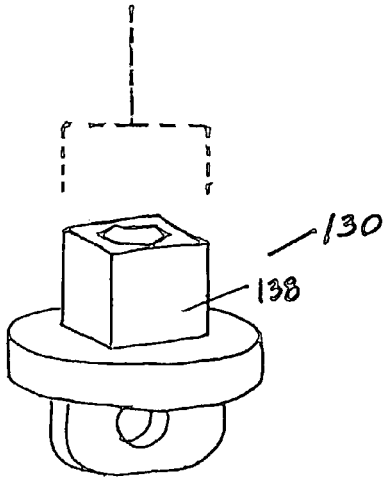
FIG. 13j

FIG. 18A

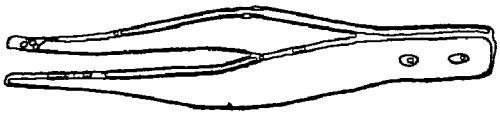

(Illustration of Prior Art)

FIG. 18B

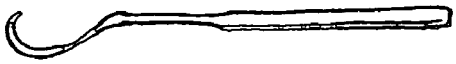

(Illustration of Prior Art)

FIG. 18C

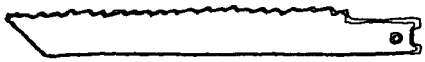

(Illustration of Prior Art)

FIG. 18D

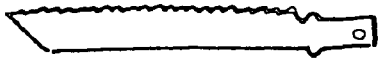

(Illustration of Prior Art)

FIG. 18E

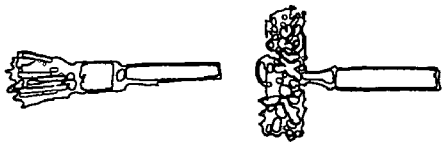

(Illustration of Prior Art)

FIG. 18F

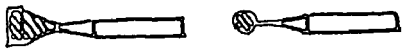

(Illustration of Prior Art)

FIG. 18G

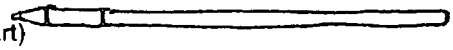

(Illustration of Prior Art)

FIG. 18H

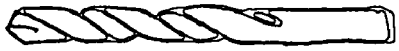

(Illustration of Prior Art)

FIG. 18I

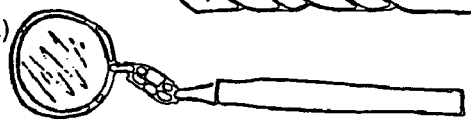

(Illustration of Prior Art)

FIG. 18J

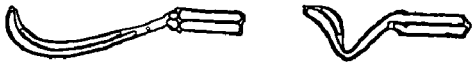

(Illustration of Prior Art)

FIG. 18K

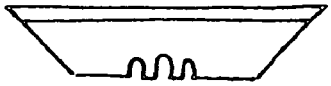

(Illustration of Prior Art)

FIG. 18L

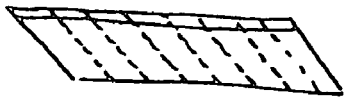

(Illustration of Prior Art)

FIG. 18M

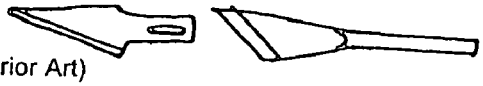

(Illustration of Prior Art)

FIG. 18N

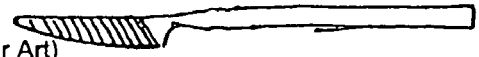

(Illustration of Prior Art)

FIG. 18O

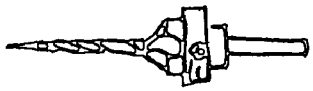

(Illustration of Prior Art)

FIG. 18P

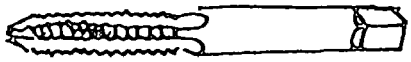

(Illustration of Prior Art)

UNIVERSAL, INTERCHANGEABLE TOOL ATTACHMENT SYSTEM

CROSS REFERENCE TO RELATED APPLICATIONS

This application claims the benefit of the filing of U.S. Provisional Patent Application Ser. No. 60/332,259, entitled "Multi-Purpose Hand Tool Specifications", filed on Nov. 20, 2001, and the specification thereof is incorporated herein by reference.

BACKGROUND OF THE INVENTION

1. Field of the Invention (Technical Field)

The present invention relates generally to hand tools, particularly to a universal, interchangeable tool attachment system for configuring a hand tool.

2. Background Art

Multi-tools are typically pliers-based hand tools, which have additional tools stored in one or both handles of the pliers. Examples of the tools found in multi-tool handles include, knife blades, screwdrivers, files, and saw blades. These tools fold into the multi-tool's handles, much like a folding pocketknife stores various blades. Some multi-tools also include stamped rulers on one or both handles.

Prior art multi-tools contain a limited, manufacturer preselected set of tool options in the multi-tool handles. This presents two problems: damaged parts permanently compromise the tool's use, and the limited tool selection may not meet the user's specific needs.

Examples of prior art multi-tools are found in U.S. Pat. No. 6,047,426 to McIntosh, et al., entitled "Folding Multi-Tool With Adjustable Pliers; U.S. Pat. No. 6,023,805 to Lin, entitled "Tool Combination Having Easily Changeable Tool Members"; U.S. Pat. No. 5,735,005 to Wang, entitled "Multifunctional Tool Assembly"; U.S. 1,561,993 to Nielsen, entitled "Combination Tool"; U.S. Pat. No. 2,168,405 to Haas, entitled "Tool"; U.S. Pat. No. 3,370,307 to Beeks, entitled "Combination Tool Device"; U.S. Pat. No. 3,798,687 to Stevens, entitled "Multiple Hand Tool"; U.S. Pat. No. 3,858,258 to Stevens, entitled "Multiple Hand Tool"; U.S. Pat. No. 4,122,569 to Hitchcock, entitled "Integrated Universal Tool"; U.S. Pat. No. 4,238,862 to Leatherman, entitled "Pocket Multiple Tool"; U.S. Pat. No. 4,888,869 to Leatherman, entitled "Lock-Bar Foldable Tool"; U.S. Pat. No. 4,942,637 to Yeang-Yai, entitled "Double-Purpose Hand Tool"; U.S. Pat. No. 5,029,355 to Thai, entitled "Folding Utility Tool"; U.S. Pat. No. 5,142,721 to Sessions, et al., entitled "Pocket Tool With Retractable Jaws"; U.S. Pat. No. 5,212,844 to Sessions, et al., entitled "Pocket Tool With Retractable Jaws"; U.S. Pat. No. 5,267,366 to Frazier, entitled "Combination Hand Tool With Retractable Pliers Jaws"; U.S. Pat. No. 5,432,968 to Beck, entitled "Utility Hand Tool"; U.S. Pat. No. 5,826,338; U.S. Pat. No. 5,920,935 to Beck, entitled "Combination Hand Tool"; U.S. Pat. No. 6,006,385 to Keshaw, et al., entitled "Multi-Tool"; U.S. Pat. No. 6,101,654 to Cachot, entitled "Multifunctional Pocket Tool Including Pliers"; U.S. Pat. No. 5,916,277, to Dallas, entitled, "Multi-Function Tool With Removable Head"; and U.S. Pat. No. 6,430,768 to McIntosh, et al., entitled "Folding Multi-Tool With Adjustable Pliers".

These patented devices are unsatisfactory in multiple regards, primarily due to the inability to modify the tool selection available and to remove or replace a particular tool when necessary. These devices remain an integral unit that cannot be re-configured by removing, replacing, or adding components. The vast majority of multi-tools have a pliers-based head permanently attached to the handles, or body of the multi-tool.

The present invention, in contrast, provides the ability to modify the tool selection contained within the handles. The present invention also provides the user the capability of easily replacing damaged or unneeded tools with other tools, with available "off-the-shelf" components, or proprietary components.

The present invention comprises a universal, interchangeable attachment system, with various pliers-like operator heads, removable/interchangeable handles, and removable/replaceable tools and tool bits. The flange ends of the components are perforated with an opening. By this means, components can be fastened together through the use of removable pins into a variety of configurations. These pins, which can be removed without the use of tools, allow nearly infinite reconfiguration and expansion of the basic system.

The invention is configurable and re-configurable to provide a variety of tools to the user. The invention includes a non-incremental ratchet tool operating via a double helical drive, electronic measuring device, removable tool cartridges, attachable tools, attachable operator heads, and tool bits. A hex drive and a clamp provide the ability to hold a variety of tools as needed by the user.

SUMMARY OF THE INVENTION (DISCLOSURE OF THE INVENTION)

The present invention is an interchangeable tool attachment system comprising at least one attachable handle, a variety of tool cartridges adapted for placement within the handles, a variety of attachable tool operator heads, connection means for attaching system components, and readily removable pins for attaching system components. The present invention is further a method of attaching components of the tool system.

The present invention is still further a helical drive mechanism for driving rotational tools. The present invention is also an electronic subsystem for use in connection with the tool system. The invention includes a tool cartridge system adapted for placement within a tool handle. The invention is also an interchangeable tool operator head whereby different blades or jaws can be interchanged upon a base portion of the operator head.

A primary object of the present invention is to provide a multi-tool that is readily configurable and re-configurable to adapt to a variety of applications by way of removable and replaceable components.

A primary advantage of the present invention is the ability to individualize tool selection. Another primary advantage of the present invention is the removable cartridge system for containment of a variety of "off-the shelf" tools and proprietary tools. Yet another primary advantage of the present invention is the ability to drive a rotational tool with a helical drive. Still another primary advantage of the present invention is the ability to perform simple electrical measurements with an electronic subsystem cartridge. The extreme adaptability of the present invention enables the user to customize the tool system to individual needs or easily replace damaged or dulled parts.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIG. 13*a* is a drill chuck tool to be used in accordance with the present invention;

FIG. 13*b* is a magnetic bit holder to be used in accordance with the present invention;

FIG. 13*c* is a series of drill bits to be used in accordance with the present invention;

FIG. 13*d* is a space bit to be used in accordance with the present invention;

FIG. 13*e* is a hex drive nut setter to be used in accordance with the present invention;

FIG. 13*f* is the hex drive of FIG. 12;

FIG. 13*g* is a crows foot wrench to be used in accordance with the present invention;

FIG. 13*h* is a machine tool socket to be used in accordance with the present invention;

FIG. 13*i* is a socket adapter to be used in accordance with the present invention;

FIG. 13*j* is the hex drive of FIG. 12;

FIG. 18*a* is a pair of tweezers to be used in accordance with the present invention;

FIG. 18*b* is a dental tool to be used in accordance with the present invention;

FIG. 18*c* is a first saw blade to be used in accordance with the present invention;

FIG. 18*d* is a second saw blade to be used in accordance with the present invention;

FIG. 18*e* is a pair of rotary brushes to be used in accordance with the present invention;

FIG. 18*f* is a pair of burr tools to be used in accordance with the present invention;

FIG. 18*g* is a pen refill to be used in accordance with the present invention;

FIG. 18*h* is a drill bit to be used in accordance with the present invention;

FIG. 18*i* is a mirror to be used in accordance with the present invention;

FIG. 18*j* is a pair of deburring tools to be used in accordance with the present invention;

FIG. 18*k* is a utility blade to be used in accordance with the present invention;

FIG. 18*l* is a snap blade to be used in accordance with the present invention;

FIG. 18*m* is a pair of Xacto® blades to be used in accordance with the present invention;

FIG. 18*n* is a riffler to be used in accordance with the present invention;

FIG. 18*o* is a counter sink drill bit to be used in accordance with the present invention; and FIG. 18*p* is a machine tap to be used in accordance with the present invention.

DESCRIPTION OF THE PREFERRED EMBODIMENTS

BEST MODES FOR CARRYING OUT THE INVENTION

The present invention comprises a universal, interchangeable attachment system. The system includes various removable/replaceable operator heads, such as pliers, scissors, or wire cutters, a ratchet capability by way of a reversible, double helical drive, a multi-function electronic subsystem, interchangeable handles, removable tool cartridges, a clip attachment device, removable tool components, and tool bit holders, including a dual retention hex drive and a clamp.

The present invention is a universal, interchangeable tool attachment system that is configurable for supplying a variety of hand tools. FIGS. 1 through 5 depict the system employing different attachable operating heads and tool cartridges for purposes of demonstrating the flexible and configurable nature of the invention.

Figure 1:
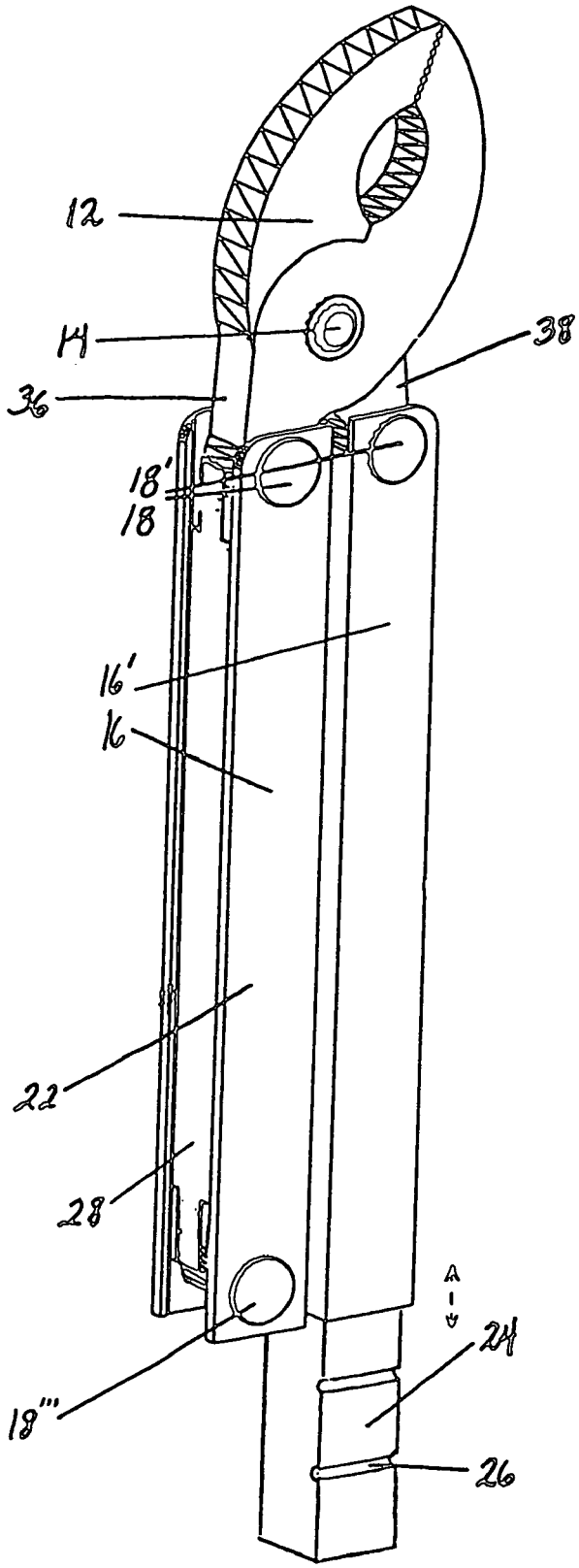
FIG. 1 is a front perspective view of the preferred embodiment of the universal, interchangeable attachment system of the present invention in a closed position with attachable operator head and tool cartridges.

Referring to FIG. 1, a front perspective view of the preferred embodiment of the universal, interchangeable attachment system 10 of the present invention is shown. System 10 is shown in a closed position with attachable tool operator head, or pliers 12. The opposing jaws of pliers 12 pivot about pin 14 between an open and a closed position for grasping an object. A first handle 16 is shown with a first extension 36 of pliers 12 attached at a distal end. A second handle 16' is adjacent first handle 16. A second extension 38 from pliers 12 is connected to a distal end of second handle 16'. Removable attachment pins 18, 18' secure the attachment of attachable operator head, such as pliers 12, to handles 16 and 16'. Although pliers 12 are shown in FIG. 1 as the attachable operator head, a variety of attachable operator heads are attachable in accordance with the present invention as will understood by those of skill in the art.

Among the attachable tool operator heads that are attachable to system 10 are scissors, wire cutters, and pliers. Among the tools attachable to system 10 by attachable clamp (see FIG. 11) or hex drive (FIGS. 12–13) are tweezers, dental tools, saw blades, rotary brushes, burrs, pen refills, drill bits, mirrors, deburring tools, utility blades, snap blades, Xacto® blades, rifflers, counter sink drill bits, machine taps, drill chucks, magnetic drill bit holders, hex bits, spade bits, hex drive nut setters, crows foot wrench, machine sockets and socket adapters. Many of these tools are depicted in FIGS. 18*a* through 18*p*.

Handle 16 is of an elongated U-shaped configuration having a first planar surface 20, a second planar surface 22, and a third planar surface (not seen) connecting the first surface 20 to the second surface 22, thereby forming a cavity within for the storage of tools and other devices, that are readily removable from the cavity due to its U-shaped configuration. In FIG. 1, a tool cartridge 28 of sufficiently small dimensions is shown contained within the cavity of handle 16 which is described below with reference to FIG. 2. The third planar surface of handle 16 abuts second handle 16'. Handle 16' is of the same U-shaped configuration as handle 16. Handle 16' is shown with an extendable, telescoping cartridge 24, which is contained within the cavity defined by handle 16' when not in use, and which extends from within the cavity defined by handle 16' when in use. Cartridge 24 comprises detents 26 so that the user can deploy the cartridge 24 to varying lengths as indicated by detents 26. This elongation capability provides the user with better leverage and power when utilized. The cavity at the distal end of handle 16' can be configured to contain any number of tools to be used with system 10.

Figure 2:
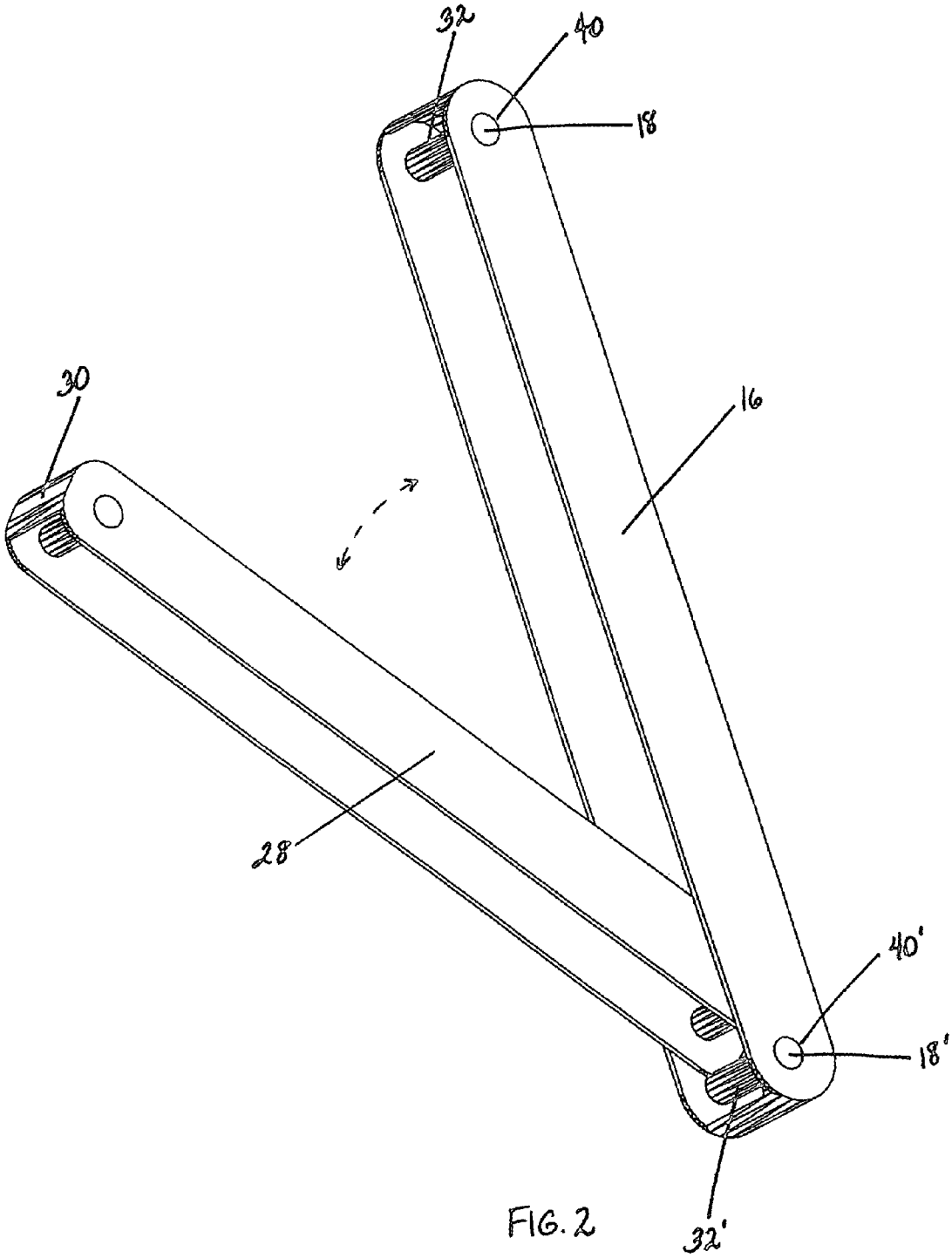
FIG. 2 is a perspective view of a handle of the universal, interchangeable attachment system of FIG. 1 in an open position with attachable tool cartridge.

Attention is now turned to FIG. 2 which shows a perspective view of handle 16 with tool cartridge 28 partially deployed from the cavity defined by handle 16. The external dimensions of cartridge 28 are such that it can be embedded within handle 16. Each handle of system 10 defines an insertion opening 40 at the distal end and an insertion opening 40' at the near end for receiving mating removable pins 18, 18' (see also FIG. 17). Cartridge 28 is fixedly held within the cavity of handle 16 by a frictional fit whereby cartridge 28 "snaps" into place and is held within the cavity when positioned within the cavity. First end 30 of cartridge 28 abuts the textured body 32 of pin 18, and second end (not seen) of cartridge 28 abuts the body 32' of pin 18' when cartridge 28 is positioned within the cavity of handle 16 for a frictional fit. Tool cartridge 28 is configured for containment of a variety of tools, as will be described further below.

Cartridge 28 has many benefits to the user, including the ability to operate two of the system's devices at one time. For example, the user has the ability to grasp and stabilize a bolt with the pliers operating head while driving the corresponding nut with a screwdriver from a deployed cartridge.

Figure 3:
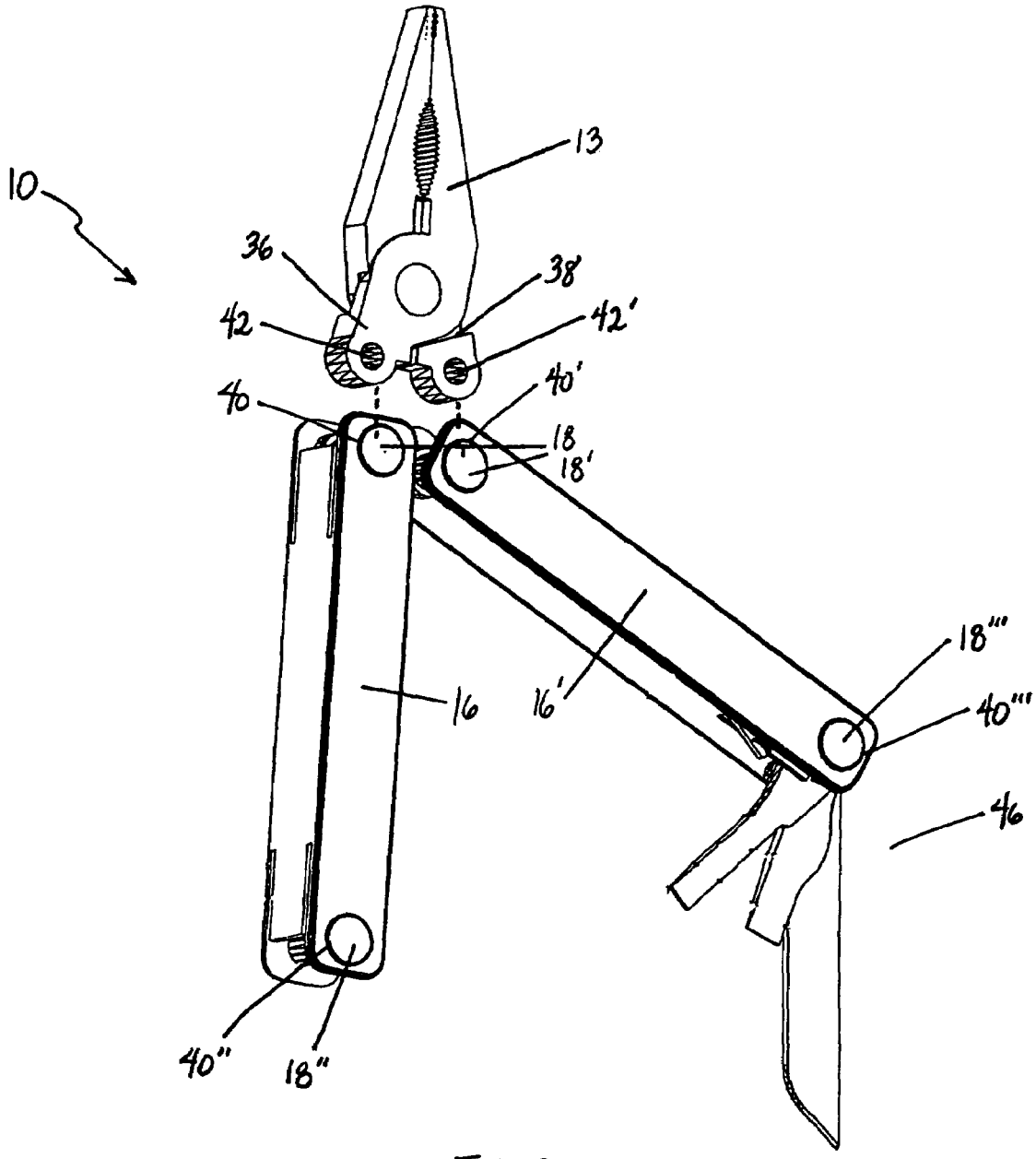
FIG. 3 is a front perspective view of the universal, interchangeable attachment system demonstrating the separation of an attachable tool by means of removable attachment pins.

Referring to FIG. 3, a perspective view of a configuration of the universal, interchangeable tool attachment system 10 is shown. Attachable tool operator head, or needle-nose pliers 13, are shown detached from handles 16 and 16'. In order to secure pliers 13, or other operating head such as pliers 12, to handles 16, 16', removable attachment pins 18, 18' are first removed from mating insertion openings 40, 40' of the distal ends of handles 16, 16'. Pliers 13 are then positioned such that cylindrical openings 42 and 42', defined within extensions 36 and 38, of pliers 13 align with openings 40 and 40' of handles 16 and 16'. Once openings 42 and 42' are aligned with insertion openings 40 and 40', removable attachment pins 18 and 18' are inserted through mating insertion openings 40 and 40' and through cylindrical openings 42 and 42' of pliers 12 to secure pliers 12 to handles 16, 16'. Removable pin 18 is described in detail below with reference to FIG. 17.

It will understood by those of skill in the art that extensions 36 and 38 and associated cylindrical openings 42 and 42' of pliers 12 can alternatively be formed such that extensions 36 and 38 fit around the exterior of handles 16 and 16' rather than within the first and second planar surfaces of handles 16 and 16'. With continuing reference to FIG. 3, handle 16' is shown with one or more representative hand tools, for example screw driver heads, files, knives, etc., partially deployed from handle 16' in the area generally referred to at 46. Tools 46 are pivotably and removably attached to handle 16' by way of removable pin 18''' insertable through mating insertion opening 40'''. Once affixed to the near end of handle 16' by insertion of pin 18''', tools 46 remain enclosed within handle 16', and are deployable from handle 16' for use as depicted in FIG. 3. Because attachable tools 46 are removably attached by pin 18''', they are readily removed and replace as needed.

In an alternative embodiment (not shown in FIG. 3), a "snap-in" cartridge as described above with reference to FIG. 2 can be used for containment of tools 46. Once removed from handle 16', tools 46 are deployed from the snap-in cartridge as needed. While not shown in FIG. 3, but as will be understood by those of skill in the art, handle 16' can alternatively be affixed to pliers 13 180° in the opposite direction such that tools 46 are deployable in a direction toward the exterior of system 10, rather than being deployable toward handle 16, as shown in FIG. 3.

Figure 4:
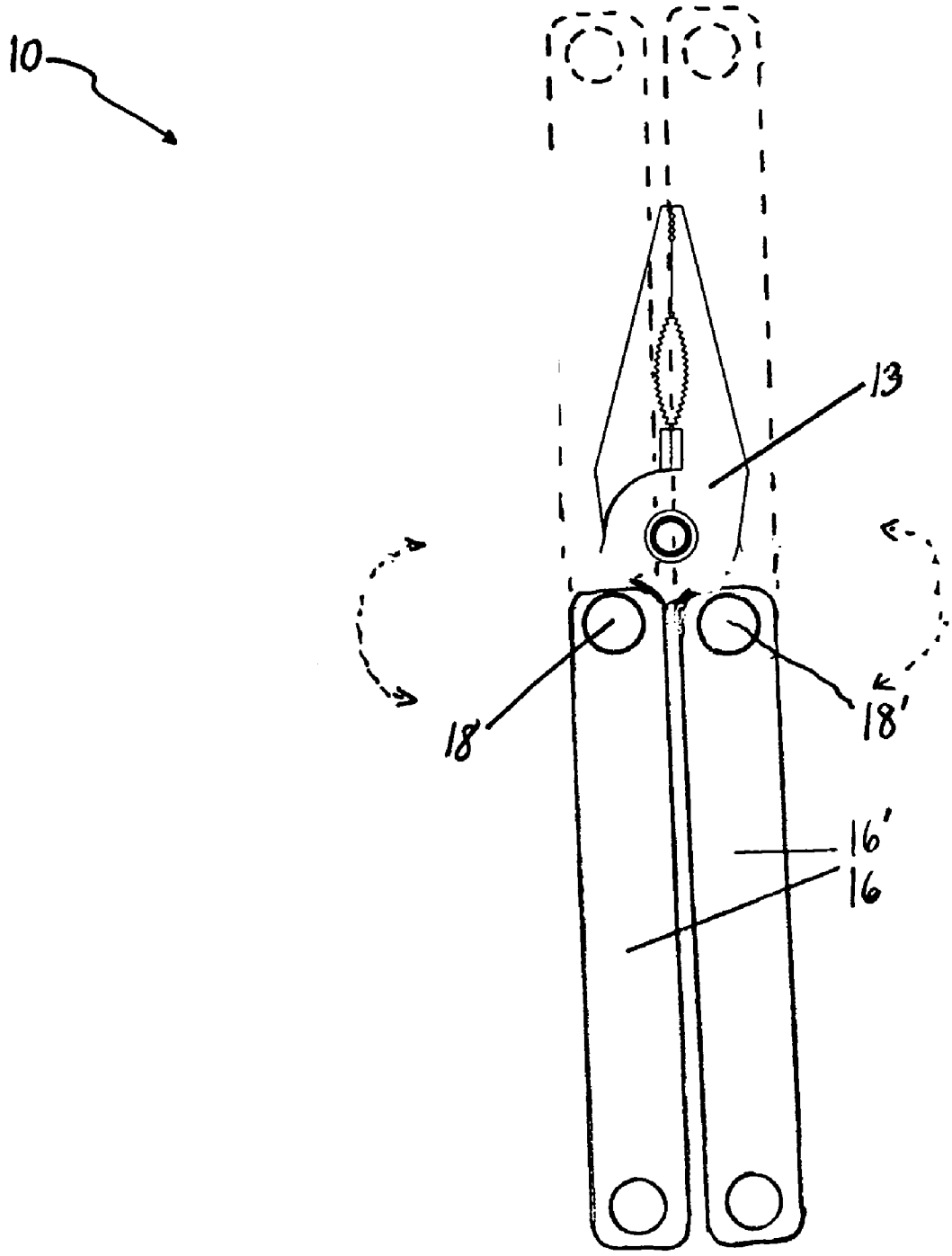
FIG. 4 is a front view of the universal, interchangeable tool attachment system utilizing two handles and an attachable tool, demonstrating the handles folding around and enclosing the attachable tool.

Referring to FIG. 4, a front view of system 10 is shown with handles 16 and 16'. Because handles 16, 16' are pivotable about pins 18 and 18', handles 16, 16' are rotatable upward 180° in order to enclose attachable tool operator head 13 within the cavities defined by handles 16, 16'. Handles 16, 16' are thereby pivotable between a first position whereby pliers 13, or other operational tool head, are revealed for use, and a second position whereby handles 16, 16' enclose pliers 13 within the cavities defined by handles 16, 16'. Of course, handles 16, 16' are attached to pliers 13 such that the openings to the cavities defined by handles pliers 13 face each other allowing for the enclosure of pliers 13 when handles pliers 13 are pivoted upward toward one another.

Due to the pivotable, removably attachable nature of handle 16 of the present invention, any number of handles of suitable dimensions can be combined in accordance with the present invention by way of pins 18, and respective mating insertion openings 40. (See FIG. 3) FIGS. 1 and 3 depict system 10 with two handles, 16 and 16'.

Figure 5:
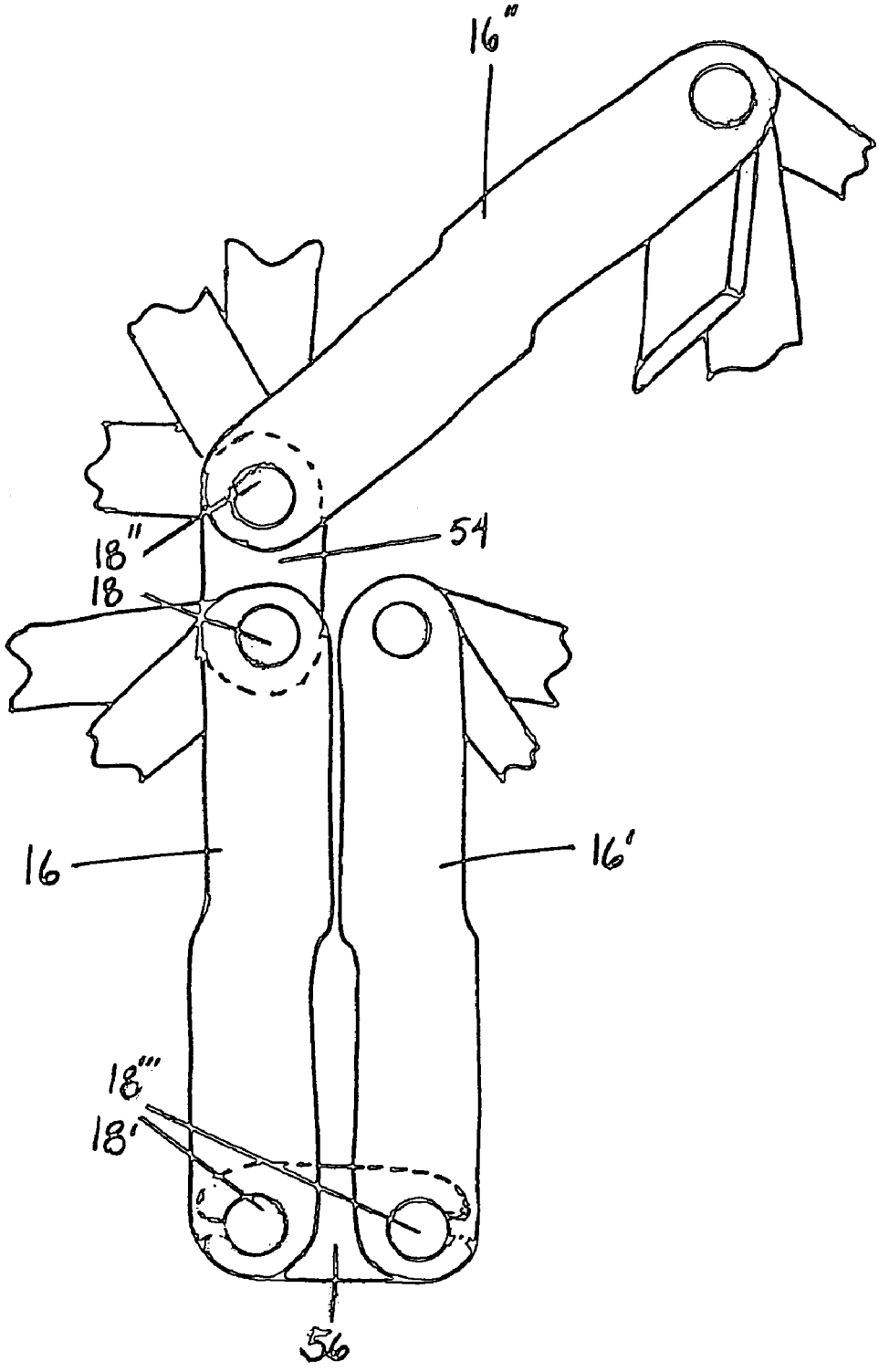
FIG. 5 is a front view of the universal, interchangeable tool attachment system demonstrating the use of connection means for connecting system components.

Attention is now turned to FIGS. 5 and 6. FIG. 5 is a front view of a configuration of system 10. FIG. 5 shows system 10 utilizing three handles 16, 16' and 16" where an end of one handle is connected to an end of another handle by a connection means, such as a link or clip, affixed to the associated removable pins 18 for each handle. A variety of connection means are used to connect one handle to the next, or to connect any of a variety of the components of system 10. Various embodiments of the connection means are shown in FIGS. 6*a* through 6*g*. In FIG. 5 the distal end of handle 16 is pivotally connected to an end of handle 16" by standard link 54 (see FIG. 6*d*). Handle 16 is attached at the near end to the near end of handle 16' by snap clip 56 (see FIG. 6*c*).

Referring now to FIGS. 6*a* through 6*g*, a variety of connection means for connecting handles 16, as well as other system components, are shown.

Figure 6A:
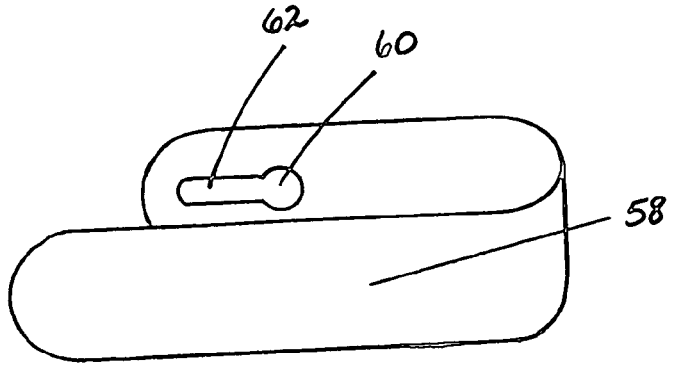
FIG. 6*a* is a front perspective view of a hanger clip connection means used for fastening the present invention to another object.

A further benefit of the present invention is the incorporation of an attachment device, or hanger clip, as shown in FIG. 6*a*. The majority of current multi-tools are carried in a sheath, which is either threaded through the user's belt or attached with a clip. Each of the present invention's removable tool cartridges preferably incorporates a clip, which the user can use to directly attach the cartridge and/or tool to almost any article of clothing and many objects at the work site, including but not limited to a belt, pocket, or pouch, etc. This enables quick access to the tool and its component cartridges without removal from a sheath, or unthreading a sheath from a belt.

FIG. 6*a* shows hanger clip 58 with a sliding lock-type fastener. Hanger clip 58 is of a sufficiently rigid U-shaped configuration attachable to an end of a handle, tool, cartridge, or other system component, by placing opening 60 over head 71 of pin 18 (see FIG. 17) until body 32 is within opening 60, and sliding hanger clip 58 in a longitudinal direction such that body 32 of pin 18 passes through elongated opening 62. Once the head 71 of pin 18 is secured in elongated opening 62, hanger clip 58 is secured to the system component. It will be understood that the orientation of openings 60 and 62 can be reversed (rotated 180°), or arranged at 90° to that shown in FIG. 6*a*, in accordance with the invention. Once hanger clip 58 is secured to the system component, system 10 can be hooked to a belt, pocket, railing, or other object. This configuration further allows the user to rotate system 10 about hanger clip 58 as needed for hanging system 10.

Figure 6B:
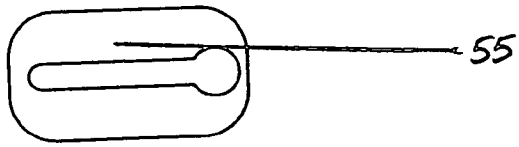
FIG. 6*b* is a front view of a first embodiment of the connection means used in accordance with the present invention.

FIG. 6*b* shows standard clip 55 that is attachable to a component of system 10, in the same manner as the hanger clip of FIG. 6*a*. Once attached, clip 55 can in turn be used to connect a variety of devices or objects to system 10, such as a set of keys.

Figure 6C:
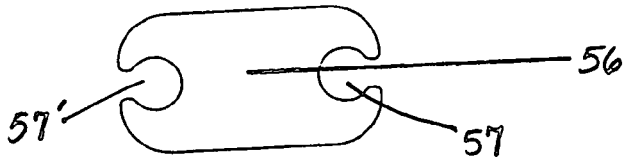
FIG. 6*c* is a front view of a second embodiment of the connection means used in accordance with the present invention.

FIG. 6*c* shows snap clip 56 used to connect system components. The openings 57 defined at each end of snap clip 56 fit over body 32 of pin 18. Force is then applied to "snap" clip 56 into place over body 32 of pin 18 thereby securing pin 18 in snap clip 56 by a detachable frictional fit. Snap clip 56 is used for rapid attachment and detachment of system components.

Figure 6D:
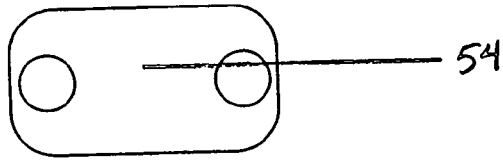
FIG. 6*d* is a front view of a third embodiment of the connection means used in accordance with the present invention.

FIG. 6*d* shows standard link 54. Link 54 is used for a more permanent connection of system components. An opening defined at an end of link 54 is aligned with an opening of a system component, such as opening 40 of handle 16 (see FIG. 3). Pin 18 is then placed through opening 40 of handle 16 and through the opening of link 54. The opposite end of link 54 is then connected to another system component in similar fashion in order to join the second system component to the first.

Figure 6E:
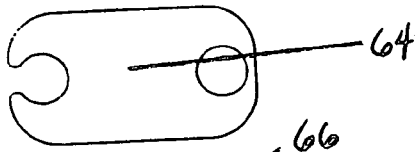
FIG. 6*e* is a front view of a fourth embodiment of the connection means used in accordance with the present invention.
Figure 6F:
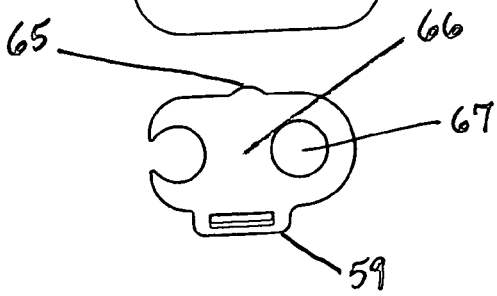
FIG. 6*f* is a front view of a fifth embodiment of the connection means used in accordance with the present invention.

FIG. 6*e* shows single snap link 64. Single snap link 64 provides a standard, more permanent, connection at one end to a system component, and a readily attachable/detachable snap connection at the opposite end. FIG. 6*f* shows an alternative single snap link 66 that is used as an integral cam locking/unlocking mechanism, and is discussed below with reference to FIG. 7.

Figure 6G:
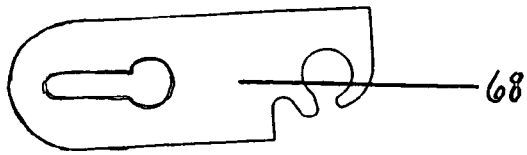
FIG. 6*g* is a front view of a sixth embodiment of the connection means used in accordance with the present invention.

FIG. 6*g* shows elongated clip 68. Elongated clip 68 provides a sliding lock-type fastener at one end and a snap connection at the other. Clip 68 is useful for securing two handles in a closed position. A handle is pivotable about pin 18 and the sliding lock-type fastener at one end of clip 68, and the snap connection at the other end of clip 68 is then snapped over pin 18 of an adjacent second handle. (See FIG. 1.)

It will be understood by those of skill in the art that an endless variety of configurations of the types of connection means shown in FIGS. 6*a* through 6*g* can be used in accordance with the principles of the present invention.

Figure 7:
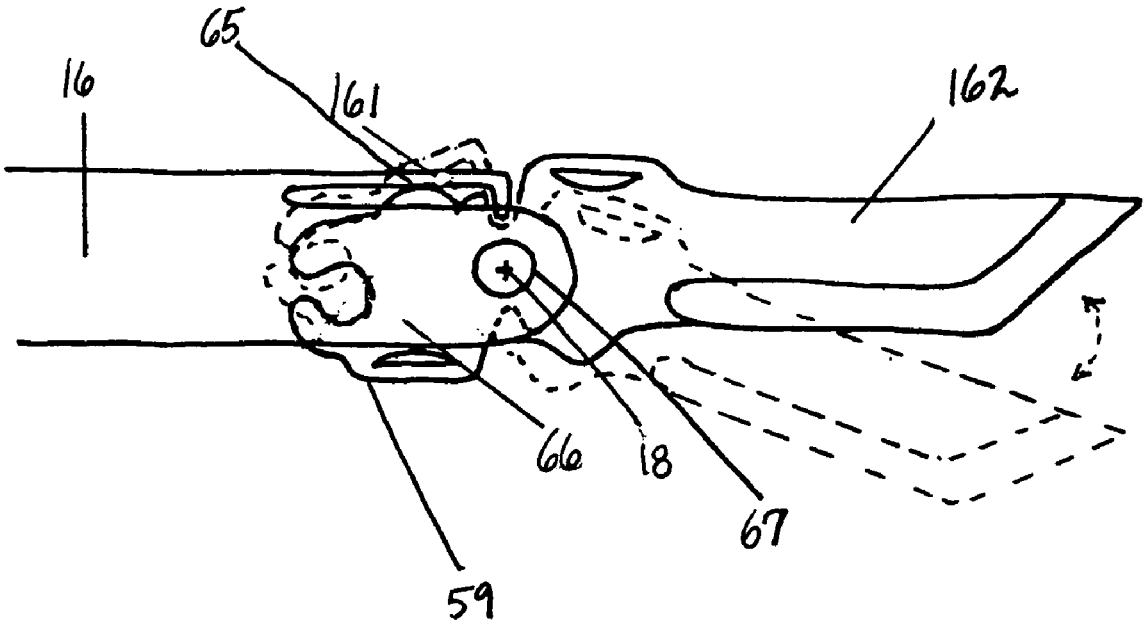
FIG. 7 is a side view of a tool of the present invention incorporating an integral cam-type locking and unlocking mechanism.

Referring to FIG. 7, a side view of handle 16 with snap link 66 (FIG. 6*f*) connected to an end of handle 16 with pin 18 is shown. When opening 67 of snap link 66 is threaded by pin 18 of a handle 16, snap link 66 is rotatable perpendicular to handle 16 and can be snapped onto a pin of an adjacent handle thereby holding the handles together in a closed position, much in the same manner as described above with reference to FIG. 6*g*. If snap link 66 is not snapped to an adjacent handle's pin, link 66 can be rotated and housed within the cavity defined by handle 16. In this position, the cam side 65 of link 66 abuts against the interior of the third planar surface of handle 16.

With continuing reference to FIG. 7, blade 162 is also secured to handle 16 and link 66 with pin 18. In this embodiment of handle 16, flexible arm 161 is integral to the third planar surface of handle 16 which is normally in a static position approximately parallel to the elongated portion of handle 16. When force is applied at tab 59 of link 66, cam 65 is pressed against flexible arm 161 thereby moving arm 161 rotatably upward, counterclockwise in FIG. 7, away from handle 16. When arm 161 is rotated upward, as indicated by the broken lines of FIG. 7, blade 162 is released from a locked position. When arm 161 is in the normally static position, blade 162 is held in a locked position whereby a hook at the end of arm 161 fits into a mating detent in blade 162. By raising arm 161, the deployed tool, or blade 162, may be folded into the tool cartridge or handle 16 for storage, or deployed and locked into position for use. Cam 65 can alternatively comprise a plurality of locking positions. A plurality of varying dimensions of cam 65 would provide a plurality of locking positions, i.e. for different angles of locked tool deployment.

Returning to a discussion of the tool operator head, the present invention has two improvements embodied in the tool operator head, or pliers 12, 13. The first is the ability to remove and/or replace the operator head with various pliers-like tools gives the system remarkable adaptability. The second improvement is the ability to adapt operator head jaws to the work at hand.

Figure 8:
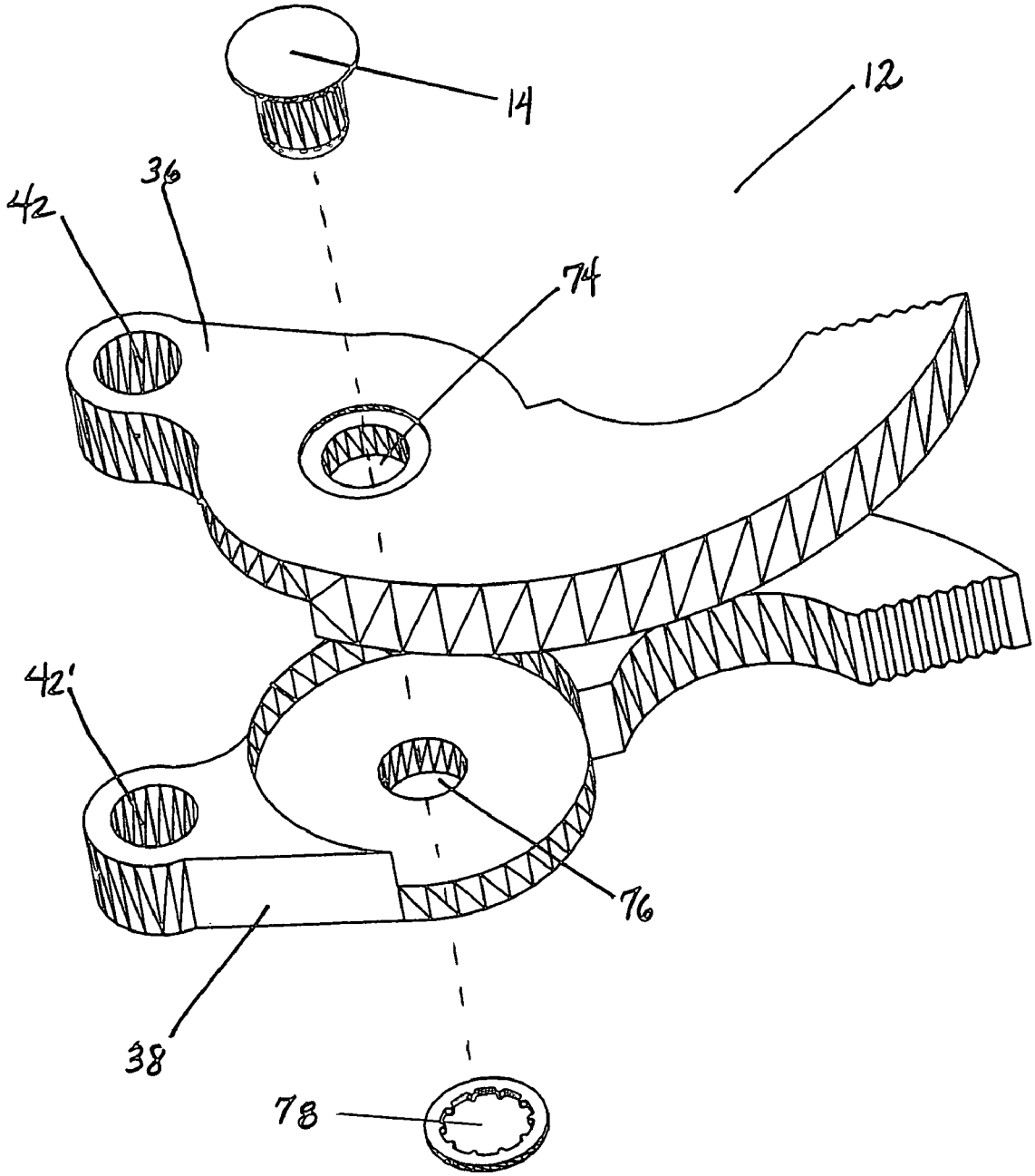
FIG. 8 is a perspective exploded view of an attachable tool and associated pivot pin and pivot clip to be used in accordance with the present invention.

Referring to FIG. 8, an exploded view of a tool operator head, or pliers 12, to be used in accordance with the present invention is shown. (See also FIG. 1.) Each jaw of pliers 12 is attachable to system 10 in the manner described above with reference to FIG. 3. Plier pivot pin 14 is insertable through mating openings 74 and 76 of the jaws of pliers 12. Pivot clip 78 is then attached to the end of pin 14 that is opposite the head of pin 14 to secure the jaws of pliers 12. Pliers 12 then pivot about pin 14. By removing pivot clip 78 from pin 14, pliers 12 are easily disassembled by the user for cleaning, repairs, and replacement, as well as for recombination of a variety of operator head types. The ability to reconfigure operator heads depending on the user's needs demonstrates the system's unique adaptability. While plier jaws are shown in FIG. 8, it will be understood that a variety of grasping tools can be configured in this manner.

Figure 9:
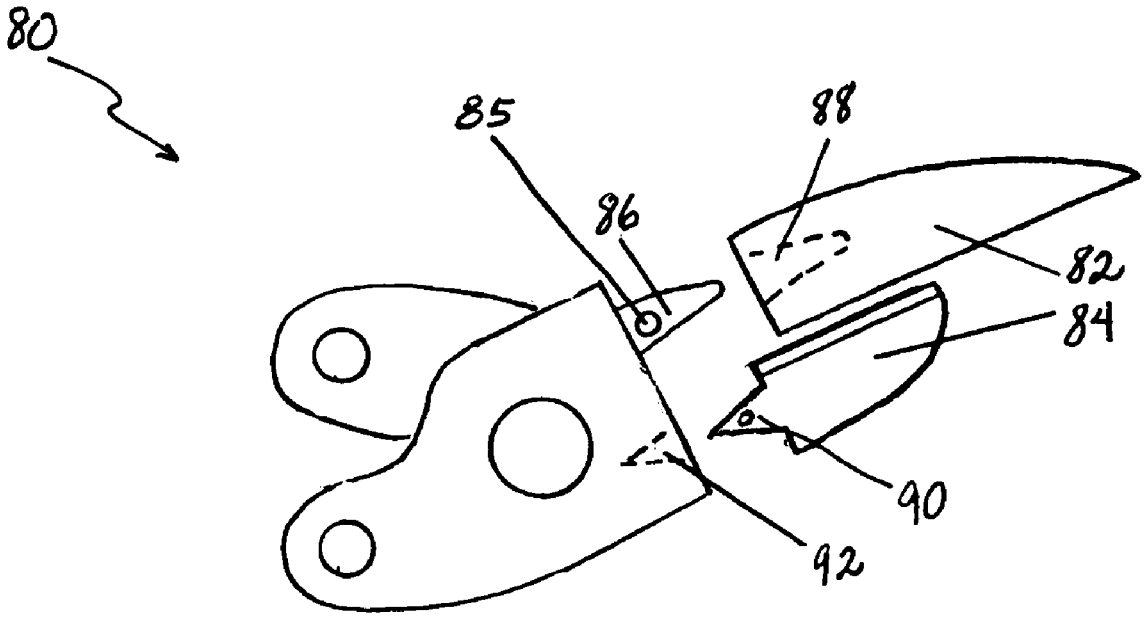
FIG. 9 is a front view of an attachable tool with detachable jaws to be used in accordance with the present invention.

Another example of a tool operator head that can be used in accordance with the present invention is depicted in FIG. 9. FIG. 9 is an exploded view of operator head 80 with removable blades, or jaws, 82 and 84. Removable blades 82 and 84 are attachable to the base of operator head 80 by mating male components and female receivers. Removable blade 82 is shown in FIG. 9 as a female blade and is attachable to the base of operator head 80 by insertion of male component 86 into female receiver 88. Removable blade 84 is attachable to the base of operator head 80 by insertion of male component 90 into female receiver 92 on the base of operator head 80. Blades 82 and 84 remain secured to the base of operator head 80 once attached by way of raised portion 85 enabling a frictional fit between mating male and female components. In this manner, a variety of types of blades, jaws, or other mechanisms can be removed and replaced as needed for the tool application at hand. Alternatively, both removable blades 82 and 84 are matably attachable to the base of operator head 80 by way of male components in the base of the operator head and female receivers in each blade, or by way of female receivers in the base of operator head and mating male components in each blade.

Figure 10:
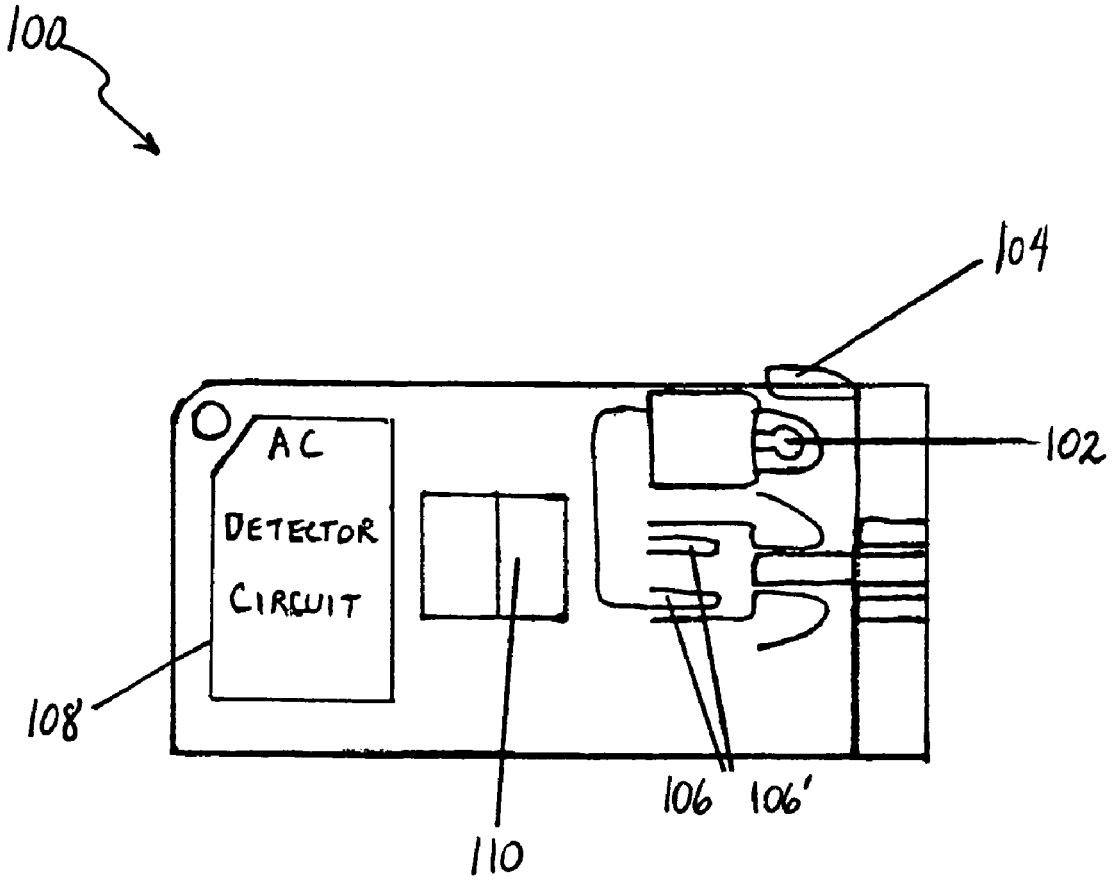
FIG. 10 is a cutaway view of an electronic subsystem used in accordance with the present invention.

Another attachable tool that can be used in accordance with system 10 is an electrical measuring tool. Referring to FIG. 10, a cutaway view of electronic subsystem 100 used in accordance with the present invention is shown. Electronic subsystem 100 contains indicator 102, such as an LED, incandescent bulb, or other suitable visual indicator, an audio indicator, a vibrator, etc., that is operational upon activation of switch 104. Indicator 102 also lights when continuity probes 106, 106' are connected across a complete electrical circuit, or when AC detector 108 senses alternating current prior to contact of the tool with an active electrical contact. Indicator 102 preferably emits light through a corresponding opening in a handle of system 10 for viewing by a user. Internal power supply 110 provides electrical power for indicator 102 and AC detector circuit 108. Wires are attachable to continuity probes 106, 106' for testing an electrical circuit. System 10, or any component of system 10 having suitable conduction capabilities, operates as the antenna for AC detector circuit 108; therefore, a user is automatically alerted to AC current when system 10 is in proximity to AC current. Electronic subsystem 100 preferably resides in a cartridge that is contained within a handle 16 of system 10, such as the cartridge shown in FIG. 2. Placement of electronic subsystem 100 in a removable cartridge enables indicator 102 to be directed as a flashlight onto the immediate work area.

Figure 11:
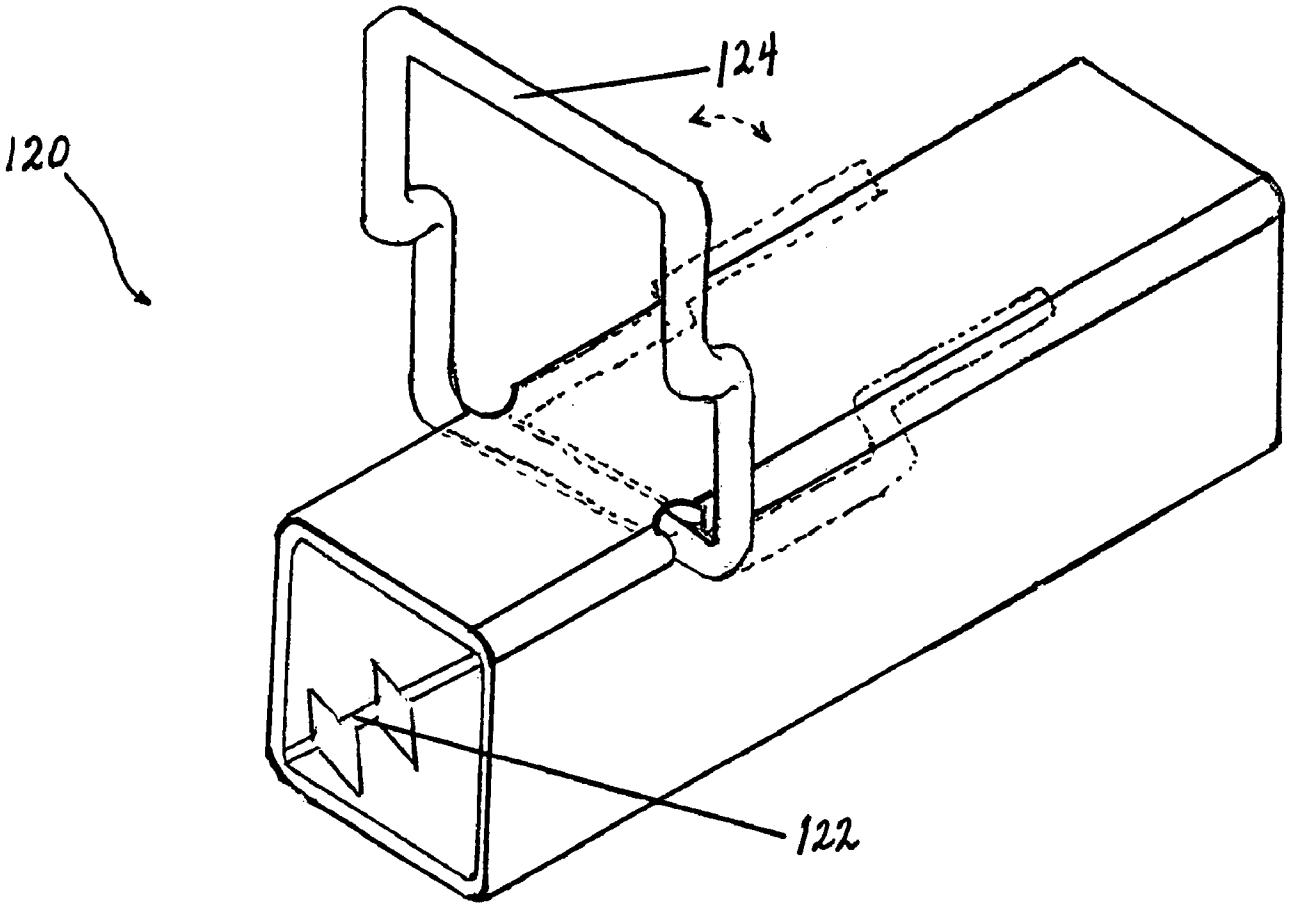
FIG. 11 is a perspective view of clamp means for securing a variety of attachable tools in accordance with the present invention.

In addition to tools, or tool cartridges, handle 16 can contain a tool securing mechanism. One such securing mechanism is clamp 120, a perspective view of which is shown in FIG. 11. Jaws 122 of clamp 120 clamp down on the flange end of a variety of "off-the-shelf" tool bits as well as specialized, proprietary tool bits. Lever arm 124 locks or releases tools or tool bits placed in clamp jaws 122, permitting easy insertion or removal while holding the tool securely when in use. Lever 124 is shown in the release position in FIG. 11, and is rotated downward toward the body of clamp 120 to tighten jaws 122 around the tool to be secured. The spring force of lever 124 presses the mating jaws of clamp 120 together. Lever 124 pivots in clamp 120 in a groove that is out of round. Because of the relatively flattened center groove, it acts as a reverse cam, or "popover switch". The spring tension of lever 124 provides compression between the handle of the tool and movable jaws 122 of the clamp and snaps into position in either the open or closed setting. The constant spring pressure in the fully closed spring position allows clamp 120 to accommodate differing tool dimensions, or thicknesses, and wear over time. Clamp 120 secures various bits and tools, including but not limited to saw blades, files, rifflers, drill bits, burrs, deburring tools, utility blades, snap blades, machine taps, etc. Clamp 120 is preferably frictionally nested within handle 16, preferably oriented such that lever 124 is accessible through the opening into the cavity defined by handle 16 and jaws 122 accessible through an end of handle 16.

Figure 12:
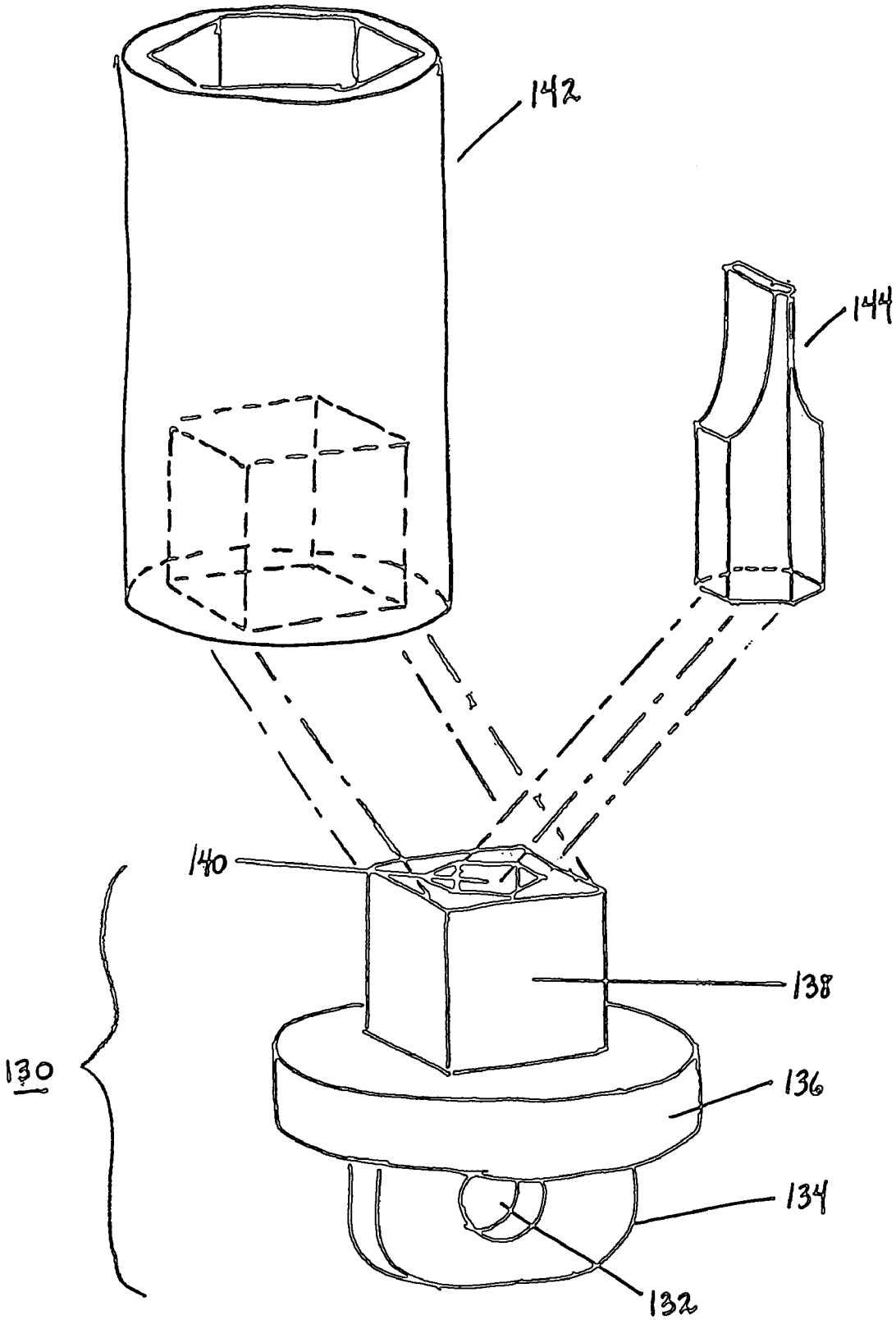
FIG. 12 is a perspective view of a hex drive for attaching tools in accordance with the present invention.

Another tool securing mechanism used with system 10 is interchangeable hex drive 130 shown in FIG. 12. Hex drive 130 is attachable to handle 16 by inserting pin 18 through opening 132 defined by semi-circular bottom portion 134, as well as through mating insertion opening 40 of handle 16 in a similar manner as described with respect to FIG. 3 when attaching a jaw of pliers 13. Hex drive 130 can alternatively be secured to and driven by helical drive at 151 (see FIG. 15*a*).

Platform 136 provides support for hex drive socket housing 138. Hex drive socket housing 138 defines hex drive socket 140 for receiving tool 144. Alternatively, hex drive socket 140 receives a socket adapter 142 for securing a different tool than tool 144.

The hex drive accommodates standard socket tool bits, i.e., flat and Phillips screwdriver bits. The unique aspect of the hex drive is its dual retention capability. The hex drive socket housing 138 fits snuggly into the base of a standard tool socket. Socket 140 is compatible with standard hexagonal drives.

Turning to FIGS. 13*a* through 13*j*, a variety of tools and adapters are shown that are attachable via hex drive 130. FIGS. 13*a* through 13*e* show a variety of tools adapted for placement in hex drive socket 140, although system 10 is not limited to securing only those tools shown. FIG. 13*a* is a drill chuck; FIG. 13*b* is a magnetic bit holder; FIG. 13*c* is a variety of hex bits; FIG. 13*d* is a spade bit; and FIG. 13*e* is a hex drive nut setter. FIG. 13*f* is the hex drive 130 of FIG. 12.

FIGS. 13*g* through 13*j* show examples of socket adapters for placement over hex drive socket housing 138. FIG. 13*g* shows a crows foot wrench adapted for placement over hex drive socket housing 138; FIG. 13*h* shows a machine socket adapter; and FIG. 13*i* shows a bit socket adapter.

Figure 14:
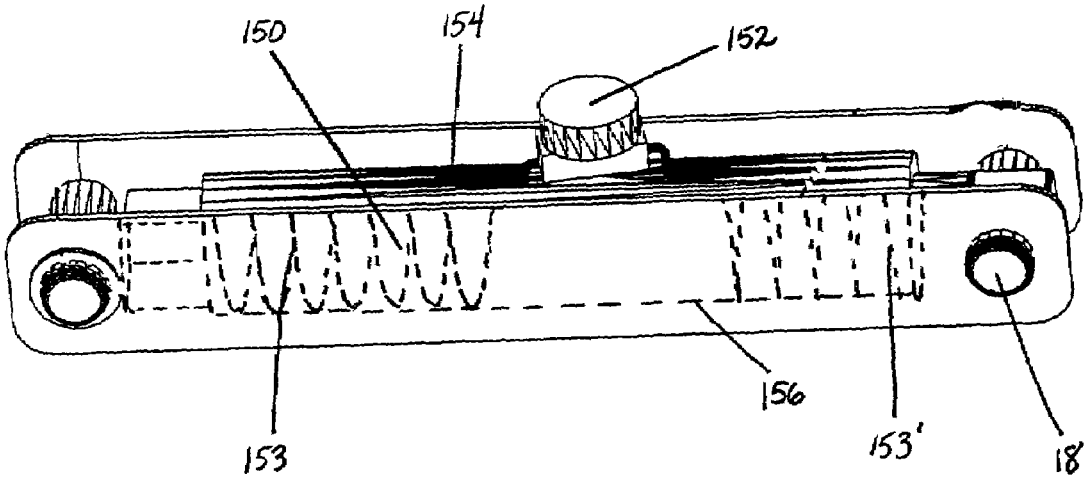
FIG. 14 is a perspective side view of a reversible double helical drive used in accordance with the present invention.

Referring to FIG. 14, a perspective side cutaway view of reversible double helical drive shaft 150 is shown. The broken lines indicate the positioning of drive shaft 150 within the drive shaft containment wall 154. Drive power is provided via coiled spring 153, 153' that is affixed at each far end to containment wall 154. Double helical drive 150 is a non-ratcheting, reversible socket drive that operates through the rotation of integrated control knob 152 that protrudes from the drive through the drive shaft's containment wall 154 and is connected internally to spring 153, 153'. Manually turning control knob 152 clockwise tightens the coils of the spring, while turning control knob 152 counter-clockwise loosens the coils of the spring. Coiled spring 153, 153' frictionally engages drive shaft 150 after the coil is tightened and causes it to rotate upon uncoiling.

Pin 18 is used at one end of helical drive cartridge 156 to connect cartridge 156 to system 10. Although FIG. 14 demonstrates a standard hexagonal drive, the fundamental drive system is adaptable to a variety of outputs other than the standard hexagonal drive as will be understood by those of skill in the art.

Figures 15A, 15B:
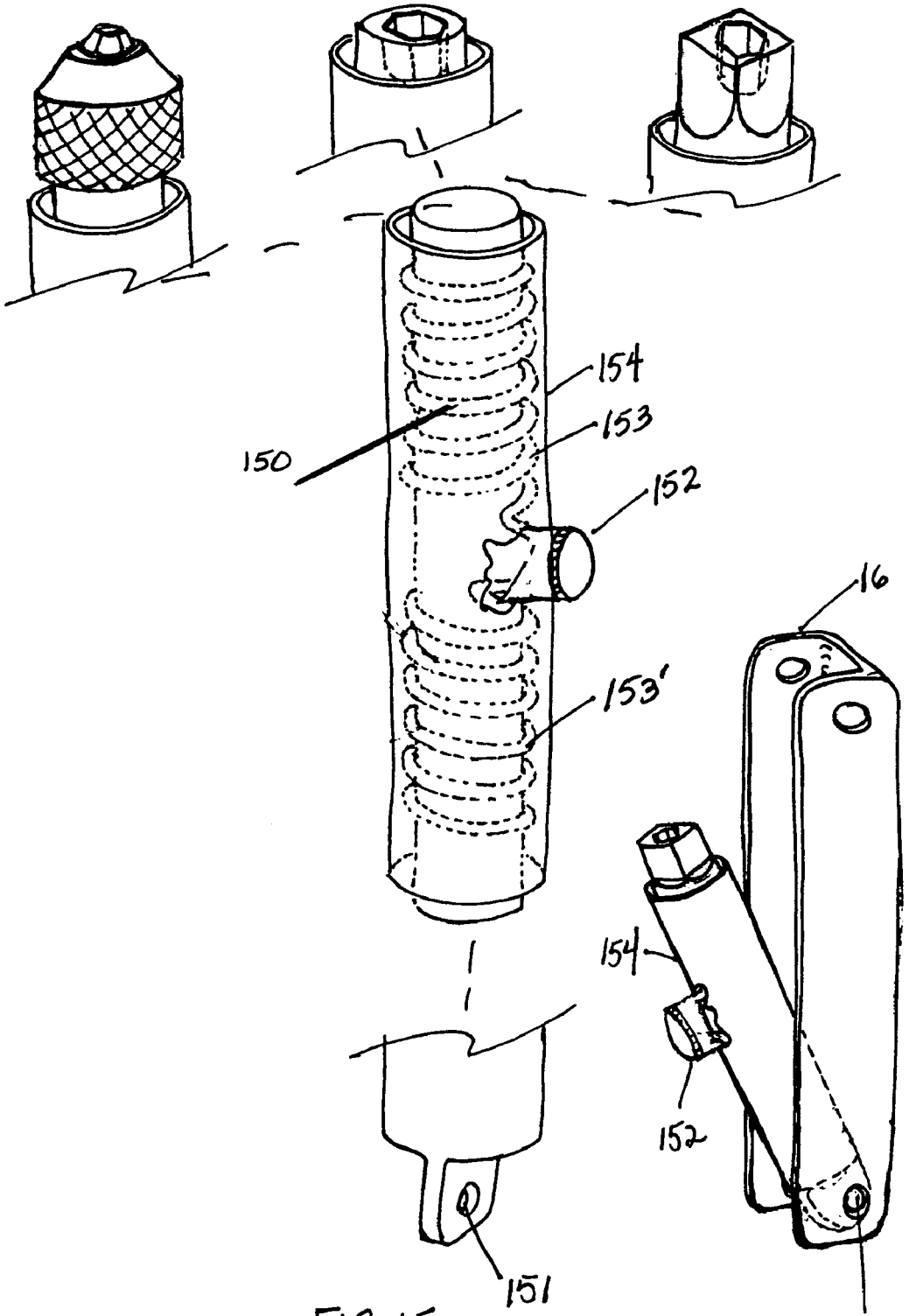
FIG. 15*a* is an exploded view of the reversible double helical drive of FIG. 14 and associated attachable tool components.
FIG. 15*b* is a perspective view of a handle containing the reversible double helical drive of FIG. 14.

FIG. 15*a* is an exploded view of double helical drive 150 with a plurality of attachable tool bits attachable at an end of double helical drive 150. FIG. 15*b* shows handle 16 with double helical drive 150 and containment wall 154 pivotably secured therein.

Figure 16:
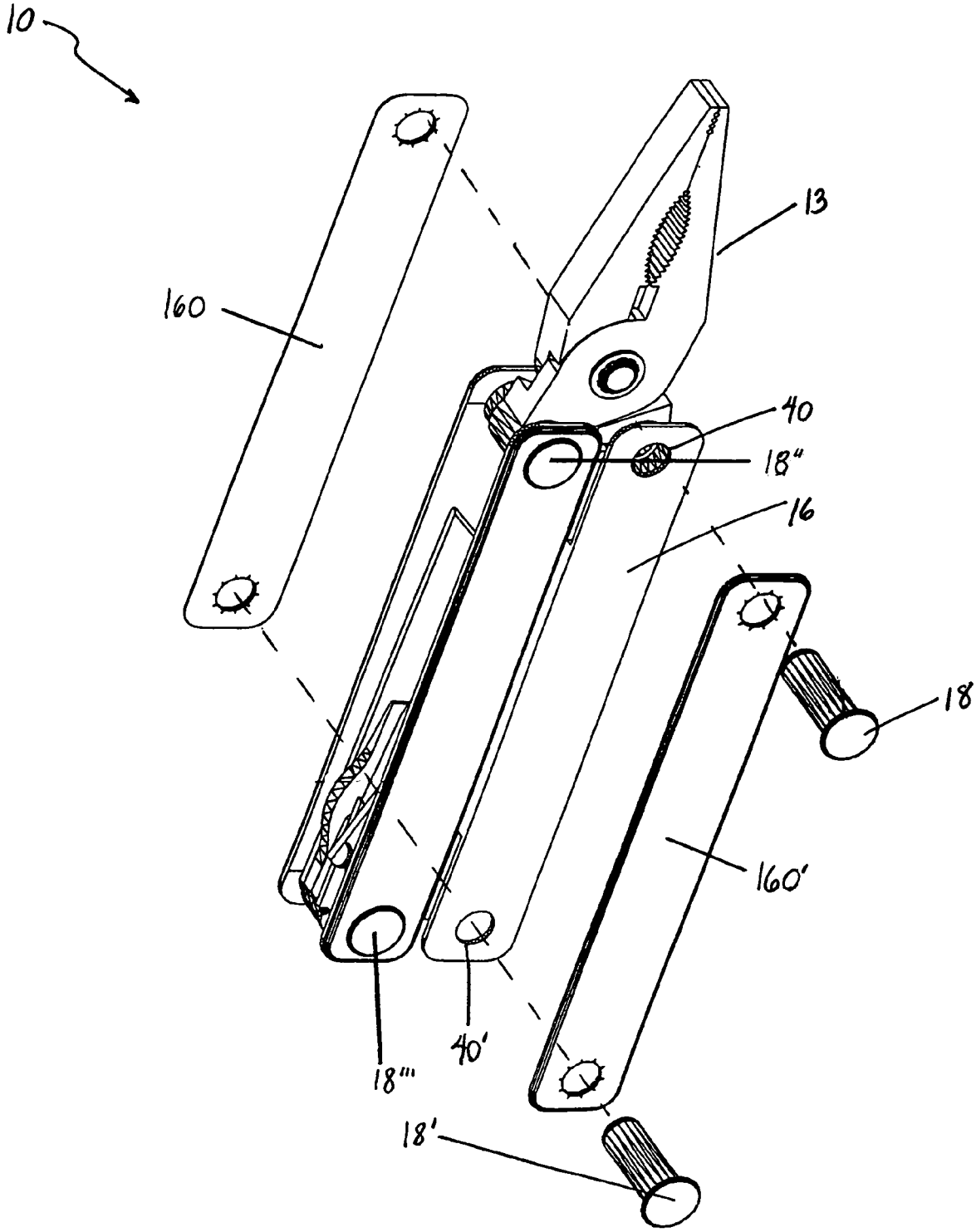
FIG. 16 is a perspective exploded view of exterior panels used in accordance with the present invention.

System 10 can optionally include exterior panels 160, 160' as shown in FIG. 16. FIG. 16 shows an exploded view of interchangeable attachment system 10. Panels 160, 160' are attachable to a handle 16 by removable pins 18. These removable panels are used as rulers, for providing drilled holes of particular sizes for wire sizing, graphic designs, and any of a variety of other measuring or visual applications.

Figure 17:
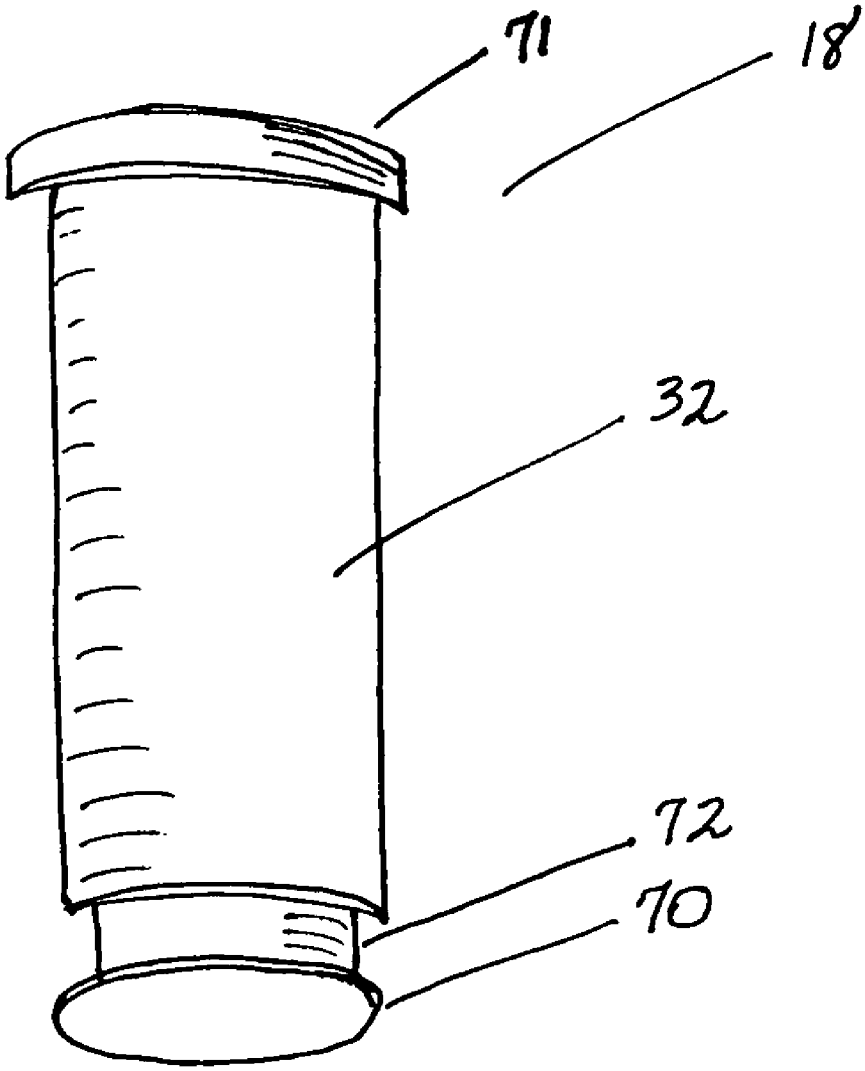
FIG. 17 is a perspective view of the removable pin used to connect various system components in accordance with the present invention.

Referring to FIG. 17, a perspective view of removable pin 18 used in accordance with the present invention for attachment and detachment of system components is shown. Pin 18 comprises head 71 at an end, textured body 32, detent 72, and locking head 70 opposite head 71. Pin 18 is readily removable and insertable by hand without the aid of additional tools. Pin 18 is pressed through mating insertion opening of a system component, such as opening 40 in handle 16 (see FIGS. 1 and 3). The textured surface of body 32 provides a frictional fit with the mating opening of the attachable tool upon inserting pin 18. Opening 42 (see FIG. 8) is preferably textured to provide additional frictional security with body 32 of pin 18. Locking head 70 protrudes through a mating insertion opening (not seen on FIGS. 1 and 3) defined by first planar surface 20 of handle 16, and detent 72 rests within mating insertion opening defined by first planar surface 20. The frictional fit of body 32 through opening 42 is such that a tool operator head is sufficiently stabilized for use.

FIGS. 18*a* through 18*p* provide examples of the variety of tools that are attachable in accordance with the present invention. FIG. 18*a* is a pair of tweezers; FIG. 18*b* is a dental tool; FIG. 18*c* is a first saw blade design; FIG. 18*d* is a second saw blade design; FIG. 18*e* is a pair of rotary brushes, each of which are attachable in accordance with the present invention; FIG. 18*f* is a pair of burr tools, each of which are attachable in accordance with the present invention; FIG. 18*g* is a pen refill; FIG. 18*h* is a drill bit; FIG. 18*i* is a mirror; FIG. 18*j* is a pair of deburring tools, each of which are attachable in accordance with the present invention; FIG. 18*k* is a utility blade; FIG. 181 is a snap blade; FIG. 18*m* is a pair of Xacto blades, each of which are attachable in accordance with the present invention; FIG. 18*n* is a riffler; FIG. 18*o* is a counter sink drill bit; and FIG. 18*p* is a machine tap to be used in accordance with the present invention.

As can be seen, the present invention's universal, interchangeable attachment system, various pliers-like operator heads, removable/interchangeable handles, removable/replaceable tools and tools bits, hex drive and clamp, creates a highly customizable tool, easily tailored to the individual user's need. With the incorporation of the uniquely designed reversible double helical drive, users are able to drive a screw or bolt without loosening and re-grasping the screw or bolt head. The electronic subsystem provides lighting and electrical testing capabilities unseen in prior art multi-tools.

Although the description herein contains specific embodiments, these should not be construed as limiting the scope of the invention, but as merely providing illustrations of some of the presently preferred embodiments of this invention. It should be noted that the invention, as described herein, is the preferred embodiment but should not be limited to the specifics described or illustrated as numerous variations are possible. The invention includes all novel and non-obvious combinations and subcombinations of various tools, elements, features, functions and/or properties disclosed herein. Modifications of the invention's elements may be made without departing from the scope of the invention as stated in the present claims.

The entire disclosures of all references, applications, patents, and publications cited above are hereby incorporated by reference.

What is claimed is:

1. An interchangeable tool attachment system comprising:

at least one easily attachable and detachable handle comprising:

a first end and a second end, at least one of said ends defining an opening for optionally attaching said at least one attachable handle to another said at least one attachable handle, said handle opening comprising a continuous periphery;

a first planar surface;

a second planar surface; and a third planar surface connected between said first and said second planar surfaces, said first, second and third planar surfaces forming a U-shaped configuration defining a cavity within said first, second and third planar surfaces, said first and second planar surfaces defining said opening in said at least one attachable handle;

at least one removable pin insertable into said opening;

a tool attachable and detachable to said at least one attachable handle, said tool defining at least one opening for attaching said tool to said at least one attachable handle with said at least one removable pin, said tool opening comprising a continuous periphery; and a tool cartridge embeddable within said cavity defined by said at least one attachable handle; and said tool cartridge comprising:

a reversible drive; and a turning mechanism for turning said reversible drive.

2. The system of claim 1 wherein said at least one removable pin comprises:

a head at an end of said at least one removable pin;

a textured body adjoining said head to provide a frictional fit;

a detent adjoining said body; and a locking head adjoining said detent.

3. The system of claim 1 wherein said tool comprises at least one tool selected from the group consisting of pliers, scissors, wire cutters, tweezers, dental tools, saw blades, rotary brushes, burr tools, deburring tools, pen refills, drill bits, mirrors, utility blades, snap blades, Xacto blades, rifflers, counter sink drill bits, drill chucks, magnetic drill bit holders, hex bits, spade bits, hex drive nut setters, crows foot wrenches, machine sockets, socket adapters, and machine taps.

4. The system of claim 1 wherein said tool comprises pliers.

5. The system of claim 4, said at least one attachable handle of said pliers comprising a first handle and a second handle and wherein said pliers comprise:

a first jaw comprising a jaw portion and an extension portion, said extension portion defining said opening for attaching said first jaw to said first handle; and a second jaw comprising a jaw portion and an extension portion, said extension portion defining said opening for attaching said second jaw to said second handle.

6. The system of claim 5 wherein at least one of said first and second jaws is detachable from said extension portion, said at least one of said first and second jaw comprising a detachably mating component, and said extension portion comprising a detachably mating component that is matable with said jaw detachably mating component.

7. The system of claim 1 wherein said cartridge comprises a first end and a second end, at least one of said ends defining an opening, said opening in said cartridge of a dimension approximately equal to the dimension of said opening defined in an end of said at least one attachable handle, said at least one removable pin insertable through both of said opening defined in said at least one handle and said opening defined in said cartridge.

8. The system of claim 1 further comprising an electronic subsystem comprising:

a power source;

at least one indicator to alert the sensing of external conditions selected from the group consisting of visual indicators, audio indicators and vibrational indicators;

an electrical switch for providing power from said power source to said indicator.

9. The system of claim 8 wherein said electronic subsystem further comprises continuity probes for connecting to an electrical circuit, said continuity probes completing a circuit for the provision of power to said indicator upon contacting a closed electrical circuit.

10. The system of claim 8 further comprising an AC detector circuit, said detector circuit completing a circuit for the provision of power to said indicator upon sensing alternating electrical current.

11. The system of claim 1 wherein said reversible drive comprises a double drive.

12. The system of claim 1 wherein said at least one attachable handle comprises two attachable handles and further comprising a removable connection comprising a planar surface defining an opening for connecting one said attachable handle to the other said attachable handle.

13. The system of claim 1 further comprising a removable connector and carrier comprising a hanger clip comprising a U-shaped configuration, a portion of said configuration defining an opening through which a portion of said at least one removable pin is insertable.

14. The system of claim 1 further comprising a removable connector comprising a planar surface defining an opening, said opening comprising a first, elongated portion having one dimension less than the diameter of a portion of said at least one removable pin, and a second portion having a dimension greater than the diameter of a portion of said at least one removable pin.

15. The system of claim 1 further comprising a removable connector comprising a planar surface defining at least one opening, said opening having a first dimension approximately equal to a diameter of a portion of said at least one removable pin and a second dimension smaller than a diameter of a portion of said at least one removable pin.

16. The system of claim 1 further comprising a removable connector comprising a planar surface defining at least one opening, wherein a dimension of said opening is less than a dimension of a portion of said at least one removable pin.

17. The system of claim 1 further comprising a removable connector comprising a planar surface defining at least one opening for receiving said at least one removable pin and a cam surface.

18. The system of claim 1 further comprising a telescoping extension removably disposed at an end of said at least one attachable handle opposite an end to which said tool attaches to provide greater reach and leverage during use of said tool.

19. The system of claim 18 wherein said extension comprises at least one detent disposed horizontally along a length of said extension to adjust said length.

* * * * *